US006179041B1

(12) United States Patent
Pleschiutschnigg

(10) Patent No.: US 6,179,041 B1
(45) Date of Patent: Jan. 30, 2001

(54) METHOD AND APPARATUS FOR THE EARLY RECOGNITION OF RUPTURES IN CONTINUOUS CASTING OF STEEL WITH AN OSCILLATING MOLD

(75) Inventor: Fritz-Peter Pleschiutschnigg, Duisburg (DE)

(73) Assignee: SMS Schoemann-Siemag Aktiengesellschaft, Düsseldorf (DE)

( * ) Notice: Under 35 U.S.C. 154(b), the term of this patent shall be extended for 0 days.

(21) Appl. No.: 09/095,274

(22) Filed: Jun. 10, 1998

(30) Foreign Application Priority Data

Jun. 16, 1997 (DE) ..... 197 25 433

(51) Int. Cl.[7] ..... B22D 11/16; B22D 11/04

(52) U.S. Cl. ..... 164/452; 164/453; 164/454; 164/416; 164/150.1; 164/155.6; 164/151.5

(58) Field of Search ..... 164/452, 453, 164/416, 150.1, 155.6, 151.5, 454

(56) References Cited

U.S. PATENT DOCUMENTS 4,532,975 * 8/1985 Ives ..... 164/416
4,669,525 * 6/1987 Kurzinski ..... 164/416
4,774,998 * 10/1988 Matsushita ..... 164/453
4,949,777 * 8/1990 Itoyama et al. ..... 164/453

FOREIGN PATENT DOCUMENTS 2415224 10/1974 (DE) .
4117073 3/1993 (DE) .
195 29 931 C1 4/1997 (DE) .
59-125248 * 7/1984 (JP) ..... 164/452
61-279350 * 12/1986 (JP) ..... 164/455

OTHER PUBLICATIONS

Patent Abstracts of Japan, vol. 006, No. 220 (M–169), Nov. 5, 1982 & JP 57 124563 A (Shin Nippon Seitetsu KK), Aug. 3, 1982.

Patent Abstracts of Japan, vol. 013, No. 193 (M–822), May 9, 1989 & JP 01 018553 A (Kawasaki Steel Corp), Jan. 23, 1989.

Patent Abstract of Japan, vol. 007, No. 041 (M–194), Feb. 18,1983 & JP 57 190760 A (Mitsubishi Jukogyo KK), Nov. 24, 1982.

Patent Abstract of Japan, vol. 006, No. 097 (M–134)), Jun. 5, 1982 & JP 57 032866 A (Kawasaki Steel Corp), Feb. 22, 1982.

* cited by examiner

*Primary Examiner*—Robert Davis
*Assistant Examiner*—I.-H Lin
(74) *Attorney, Agent, or Firm*—Friedrich Kueffner

(57) ABSTRACT

A method and an apparatus for the early recognition of ruptures when continuously casting steel using an oscillating mold constructed of copper plates, wherein the method includes continuously and comparatively measuring operating parameters, for example, the temperature distribution with respect to location and time in the copper plates, and analyzing the obtained measurement results. For increasing the probability of an accurate evaluation of indications of an acute tendency of ruptures, two measuring data to be compared are coupled with each other as well as with measuring data of at least one third measuring row, and the measuring data are preferably analyzed online.

13 Claims, 3 Drawing Sheets

METHOD AND APPARATUS FOR THE EARLY RECOGNITION OF RUPTURES IN CONTINUOUS CASTING OF STEEL WITH AN OSCILLATING MOLD

BACKGROUND OF THE INVENTION

1. Field of the Invention

The present invention relates to a method and an apparatus for the early recognition of ruptures when continuously casting steel using an oscillating mold constructed of copper plates. The method includes continuously and comparatively measuring operating parameters, for example, the temperature distribution with respect to location and time in the copper plates, and analyzing the obtained measurement results.

2. Description of the Related Art

Methods for the early recognition of ruptures in continuous casting of steel with an oscillating mold constructed of copper plates are thus far only known in the experimental stage and are based, for example, on thermoelements with tongues in the copper plates of the molds. The early recognition of ruptures is considered an important operating means in order to prevent the risks and work stoppages when ruptures of the strand shell occur which is still extremely sensitive, particularly when casting thin slabs with a speed of, for example, up to 6 m/minute and beyond. In this method, irregularities in the temperature distribution in the copper plate are measured over the casting period, are analyzed and signals are derived from the results, wherein these signals have the purpose of serving as criteria for a rupture.

Because of the relatively high thermal capacity of the copper plates, the known method reacts with a significant time delay and, therefore, can be considered substantially safe only with severe limitations.

In accordance with another method, acceleration sensors are used in an attempt to detect rupture-relevant problems in the manner of movement with respect to three axes in space during the mold oscillation. This system is deficient because the measurements do not always clearly and with a high accuracy detect a rupture. Consequently, the measurement system triggers either erroneous alarms prior to a rupture or an alarm is indicated too late or not at all.

DE 24 15 224 C3 discloses a plate mold for slabs whose mold walls have cooling chambers which define limited cooling zones. Connected to the water supply and discharge lines of the long side walls of the mold are measurement units for determining the discharged thermal quantity or the cooling capacity. In addition, an average value of the cooling capacity of the cooling chambers is simultaneously formed in the measurement units, wherein the average value is supplied to an average forming unit which is capable of controlling the conicicity of the short side walls of the mold. Because of the measurement of the heat fluxes in the mold, an early recognition of ruptures cannot be carried out with satisfactory accuracy.

DE 41 17 073 C2 discloses a method of determining by means of a calorimetric measurement in a slab mold the integral and specific heat transport at each individual copper plate. A comparison of the specific heat fluxes from the copper plate side facing the steel to the water-cooled side especially of the short side walls of the mold with the heat fluxes of the two long side walls of the mold makes it possible to regulate the conicicity of the short side walls independently of the various selected casting parameters.

This known apparatus also is not suitable for a substantially safe early recognition of an acute danger of rupture.

DE 195 29 931 C1 describes a plate mold for producing strands of steel, particularly thin slabs, wherein the long side walls have at least three cooling segments which are arranged next to one another and are independent of each other. Temperature sensors are arranged in the walls of the chambers facing the strand, wherein the temperature sensors determine at least the temperature differences between the individual chambers or zones. This document also does not disclose any suggestion for further developing these means for the determination of the temperature of areas of a mold and to utilize these means for an early recognition of ruptures.

Also known in the art are systems in which thermoelements integrated in the mold walls are used for observing the temperature changes and distribution over the casting period and for building up a rupture protection by forming difference values.

In addition, an acceleration measurement of the mold by means of at least three acceleration sensors on the mold is known in the art, wherein the measurements determine deviations in the mold movement, i.e, wobbling, as a criteria for ruptures.

SUMMARY OF THE INVENTION

Therefore, starting from the prior art discussed above, it is the primary object of the present invention to provide a method and an apparatus for the early recognition of ruptures which make it possible to provide the highest possible probability for an accurate evaluation of indications of an acute tendency of rupturing in continuous casting of steel. It should be possible to carry out the method and the apparatus as much as possible with conventional means and measuring devices.

In accordance with the present invention, for increasing the probability of an accurate evaluation of indications of an acute tendency of ruptures, two measuring data to be compared are coupled with each other as well as with measuring data of at least one third measuring row, and the measuring data are preferably analyzed online.

The method according to the present invention is based on the finding that the probability of the safety of a clear early recognition of ruptures significantly increases when several systems are tied together.

Consequently, a further development of the method provides that the partial frictional engagement between the mold and the cast strand which depends on the efficiency of the lubrication is measured by means of a third measuring row by a comparative measurement of the mold oscillation and the strand oscillation underneath the mold and the measured data are coupled with the measuring data from the temperature distribution and the distance/time behavior of the mold and the result is analyzed by computation.

This takes into consideration that the strand oscillation is a movement resulting from the mold oscillation and the coefficient of sliding friction between strand and mold. The frictional force which is built up during a strand oscillation between the mold and the strand shell is influenced, for example, by the following parameters:

- oil lubrication, or
- casting slag lubrication, and
- type of copper plate with and without coating, for example, Cr, Ni, etc.

This partial frictional engagement or the effect of the lubrication between the mold and the strand can be determined, for example, by means of a line camera. By carrying out comparative measurements of the strand oscillation underneath the mold with the mold oscillation, which can be carried out by means of acceleration sensors at the mold, it is possible to determine the friction $$R=\mu\times N$$

between the strand shell and the mold and particularly any problems in the uniformity of the friction over the circumference of the strand, for example, the strand width, particularly of a thin slab.

Consequently, another further development of the present invention provides that comparative measurements of the mold oscillation and the strand oscillation are carried out at different circumferential portions of the mold and the strand.

Therefore, another further development of the present invention provides that any problems in the uniformity of the friction occurring at different circumferential portions of the mold or of the slab are localized by means of comparative measurements over the strand circumference or over the strand width.

In accordance with another further development of the invention, the mold oscillation and the strand oscillation to be compared with the mold oscillation are preferably measured at the four corner points of the mold and are continuously compared, wherein problems are recognized by means of an analysis of the obtained measurement data in an electronic evaluating unit and are compared to predetermined rupture-relevant signals and, when the tendency to rupture is recognized, measures are initiated for preventing the rupture. For this purpose, the casting speed may be lowered and/or the supply quantity or the composition of the lubricant may be changed. In particularly critical cases, a combination of both measures may be carried out.

The observation of the strand oscillation is advantageously carried out with the use of a line camera. This utilizes the phenomenon that markings which are caused by the oscillation are visible at the outer surface of the strand shell, wherein these markings are recognized and evaluated with the appropriate adjustment by the line camera.

As already mentioned, for increasing the probability of an accurate evaluation of indications of an acute tendency to rupture, an evaluation of the measurement results of the mold and strand movements, on the one hand, and the temperature field in the mold plates or the distance/time behavior of the mold movement, on the other hand, may be coupled.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
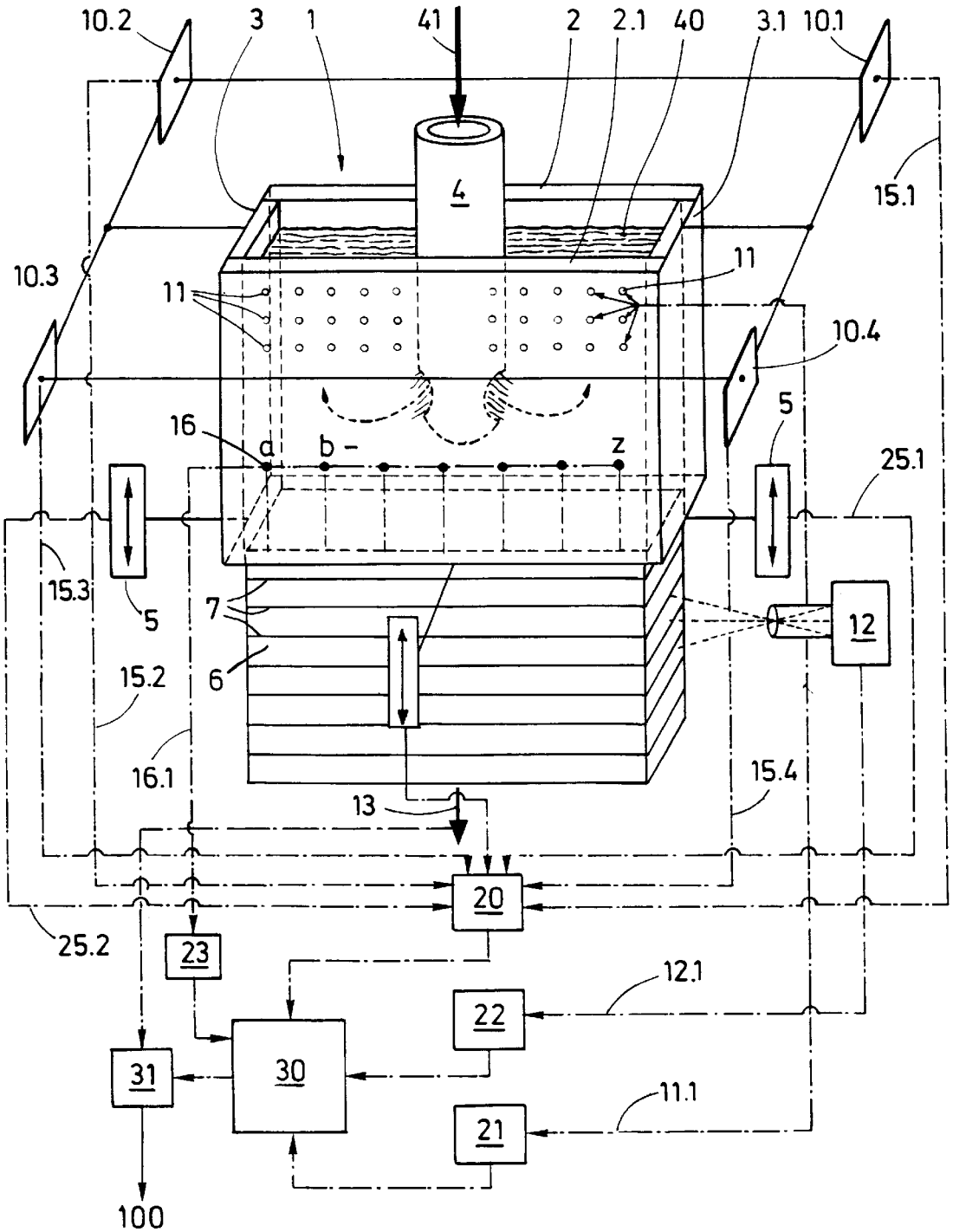
FIG. 1 is a schematic illustration of an apparatus for carrying out the method according to the present invention.

FIG. 1 of the drawing shows an apparatus for the early recognition of ruptures in continuous casting of steel which includes a plate mold 1 composed of copper plates 2, 3 and oscillated by an oscillation generator 5, particularly for carrying out the method according to the present invention.

The plate mold 1 includes a measuring and evaluating unit with the following elements.

At least one acceleration measuring unit 10.1 to 10.4 for the oscillation of the mold 1;

- a plurality of thermoelements 11 in the mold plates 2 and 3;
- a line camera 12 for detecting the strand oscillation;
- a speed measuring unit 13 for the continuous casting speed;
- an electronic evaluating unit 20 for the oscillation acceleration;
- an electronic evaluation unit 21 for temperature measurements;
- an electronic evaluation unit 22 for the strand oscillation;
- a central evaluation computing unit 30; and
- an early warning signal generator 31.

As soon as the evaluation computing unit 30 receives a combination of measuring data from the individual electronic evaluation units 20 to 22 which indicate that there is the danger of a rupture, the unit 30 produces a pulse for early warning and transmits this pulse to the signal generator 31 which, in turn, as represented by the numeral 100, starts defensive measures, for example, acts on the adjustment units for reducing the casting speed 13 or for increasing the quantity of lubricating agents 40.

FIG. 1 further shows a cylindrical submerged casting pipe 4 for introducing liquid steel 41 and the cast strand 6 which emerges at the bottom side of the mold 1 and has on the circumference thereof clearly recognizable oscillation markings 7. Acceleration sensors 10.1 to 10.4 are arranged at the four corner points of the mold 1 and are rigidly connected to the top side of the mold 1. These acceleration sensors are provided with measurement lines 15.1 to 15.4 and are connected to the electronic evaluation unit 20. Also connected to this electronic evaluation unit 20 are the measurement lines 25.1 and 25.2 which supply the signals of the oscillation generator 5, so that deviations of the distance/time behavior of the mold movement from the forcibly induced oscillation generation of the oscillators 5 can be detected.

The results of the image detection of the oscillation markings by means of the line camera 12 are provided through the measurement line 12.1 to the electronic evaluation unit 22 which, in turn, conducts a modulated signal to the central evaluation unit 30.

Finally, FIG. 1 shows a plurality of temperature sensors 11 embedded in the long side walls 2 of the copper plate mold, wherein the measurement data of the temperature sensors 11 are supplied through a multiple-strand measurement line 11.1 to the measurement and evaluation electronic unit 21 and, after evaluation of the measurement data, a signal is supplied to the central evaluation unit 30. The term "multiple-strand measurement line 11.1" is intended to mean that each individual thermoelement 11 supplies an individual measurement result through an individual strand of the measurement line 11.1 to the electronic unit 21 and, thus, is capable in this manner, for example, to localize the local uniformity or non-uniformity of the temperature distribution of a cooled plate.

The temperature difference measurement of the mold cooling water of each mold plate 2, 2.1 can also be taken into consideration for the evaluation and for increasing the probability of an early recognition of a rupture. In this regard, it is possible to use the integral value for each mold plate 2, 2.1; 3, 3.1, as well as partial values in the case of the long side walls 2*a–z*; 2.1*a–z*.

Figure 2:
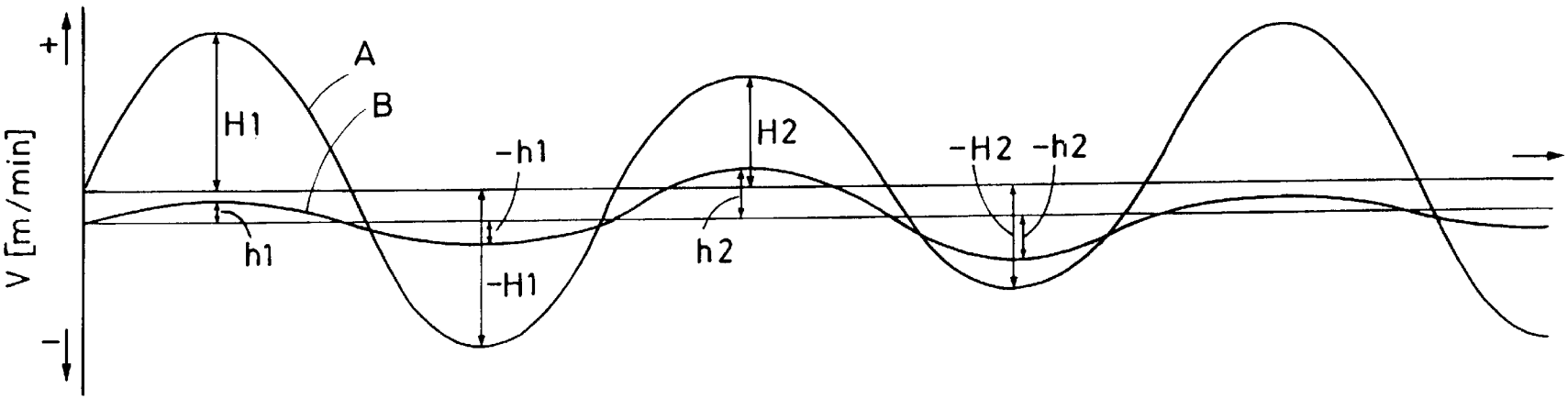
FIG. 2 is a diagram showing the oscillating movements of the mold and the strand at the moment a problem concerning the uniformity occurs.

FIG. 2 shows 2 oscillograms A and B. Oscillogram A represents the typical pattern of a problem or deviation in the distant/time behavior of the mold 1, for example, due to a problem occurring with respect to the uniformity of the friction between mold and strand. In comparison, oscillogram B represents a reciprocal oscillation behavior of the cast strand 6. When a dramatic deterioration of the sliding friction coefficient between the inner wall surfaces and the strand shell being formed occurs, the oscillations which are built up require more work, so that, with uniform frequency, the amplitude of the mold 1 drops from initially $H_1$ to $H_2$, while simultaneously, due to an increased adhering friction, the strand shell of the strand 6 is oscillated more strongly, and thus, its original amplitude $h_1$ is increased to $h_2$, so that the corresponding electronic evaluation units can analyze without doubt a deviation in the lubrication behavior and the attendant increased partial frictional engagement.

Figure 3:
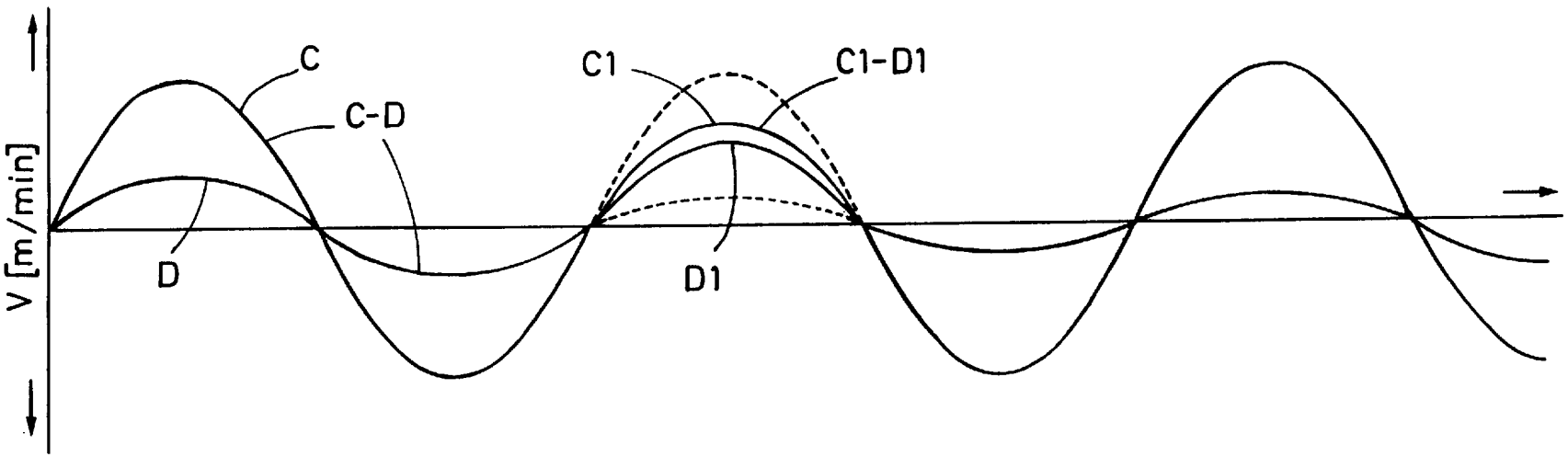
FIG. 3 is an oscillation diagram showing a significant tendency for a rupture.

FIG. 3 of the drawing shows the oscillogram C for a normally occurring mold oscillation and the oscillogram D for a normal strand oscillation without problems or deviations. C1 represents a significant oscillation of the mold and D1 indicates a significant strand oscillation. With the aid of the shaded fields C-D between the normal oscillation C of the mold and the normal oscillation D of the cast strand it is possible to determine that a normal lubrication behavior or a normal partial frictional engagement between the mold and the strand shell as it is to be expected exist. On the other hand, the shaded field C1-D1 shows a rupture criterion because a problem in the lubrication behavior, i.e., deficient lubrication, or an increased partial frictional engagement between the mold and the strand shell have very likely resulted in a change of the field C-D toward C1-D1.

In that case, for example, the early warning signal generator 31 would with a command to the adjustment units 100 reduce the casting speed 13, for example, by means of the roller drive of the continuous casting plant and would simultaneously change the supply 40 of lubricant toward a more effective lubrication. The time-controlled lowering of the casting speed may take place between 50% and 100% for a maximum time of two minutes. In that manner, by a precisely targeted early warning, an actual rupture of liquid steel can be safely prevented. Once the rupture has been prevented, a controlled acceleration of the strand to the desired speed takes place.

While specific embodiments of the invention have been shown and described in detail to illustrate the inventive principles, it will be understood that the invention may be embodied otherwise without departing from such principles.

I claim:

1. In a method for the early recognition of ruptures in continuous casting of steel with an oscillating mold composed of copper plates, by carrying out continuous and comparative first and second measurements of a temperature distribution with respect to location in the copper plates and a temperature distribution with respect to time in the copper plates, and by analyzing the obtained measurement data, wherein, for increasing the probability of a precisely targeted evaluation of indications of an acute rupture tendency, coupling the first and second measurement data to be compared to each other as well as to measuring data of at least a third row of measurements, and analyzing the coupled measurement data, the improvement comprising measuring by means of the at least one third measuring row a partial frictional engagement between the mold and a cast strand in accordance with an efficiency of lubrication by carrying out a comparative measurement of a mold oscillation and a strand oscillation underneath the mold, and coupling the measurement data together with the measurement data from the temperature distribution and a distance/time behavior of the mold and analyzing the result by computation.

2. The method according to claim 1, wherein the measurement data are analyzed online.

3. The method according to claim 1, comprising carrying out the comparative measurements of mold oscillation and strand oscillation at different circumferential areas of the mold and the strand.

4. The method according to claim 1, comprising localizing problems with respect to uniformity of friction occurring at different circumferential areas of the mold and the strand by carrying out comparative measurements over the strand circumference or the strand width.

5. The method according to claim 1, comprising measure a mold oscillation and a strand oscillation to be compared to the mold oscillation at the four corner points of the mold and continuously comparing the oscillations and recognizing problems by analyzing the obtained measurement data in an electronic evaluation unit, and comparing the analyzed measurement data with rupture-relevant signals, and when a rupture tendency is recognizable, starting measures for preventing a rupture.

6. The method according to claim 1, wherein a temperature difference measurement of mold cooling water at an inlet and outlet of each mold plate is measured integrally or partially for each long side wall of the mold.

7. The method according to claim 1, comprising carrying out as measures for preventing a rupture at least one of a lowering of the casting speed and a change of a supplied quantity or composition of lubricant.

8. The method according to claim 1, comprising carrying out an observation of a strand oscillation by utilizing a line camera.

9. A method for the early recognition of ruptures in continuous casting of steel with an oscillating mold composed of copper plates, the method comprising carrying out continuous and comparative measurements of operating parameters selected from the group consisting of a) temperature distribution with respect to location and time in the copper plates;

b) mold oscillation and strand oscillation as a measurement of a friction-dependent frictional engagement between mold and strand;

c) uniformity of friction occurring at circumferential areas of the mold;

d) temperature difference of mold cooling water between an inlet and an outlet of each mold plate, integrally or partially for each long side wall of the mold; and e) at least one of added quantity and composition of lubricant;

and analyzing the obtained measurement data, wherein, for increasing the probability of a precisely targeted evaluation of indications of an acute rupture tendency, coupling two of the measurement data a) through e) to be compared to each other as well as to measuring data of at least a third measurement, and analyzing the coupled measurement data.

10. An apparatus for the early recognition of ruptures in continuous casting of steel at a continuous casting speed with the use of a plate mold composed of copper plates and oscillated by an oscillation generator, the apparatus further comprising:

at least one acceleration measurement unit for the oscillation;

a plurality of thermoelements in the mold plates;

a line camera for recognizing strand oscillation;

a speed measurement unit for the continuous casting speed;

an electronic evaluation unit for the oscillation acceleration;

an electronic evaluation unit for temperature measurements in the mold plates;

an electronic evaluation unit for the strand oscillation;

a central evaluation computing unit; and an early warning signal generator.

11. The apparatus according to claim 10, wherein the measuring and evaluating unit further comprises thermoelements for a temperature difference measurement over long side walls of the mold.

12. The apparatus according to claim 10, wherein the early warning signal generator is connected to adjustment units for a controlled lowering of the casting speed.

13. The apparatus according to claim 12, wherein a time switch is arranged in the connection between the early warning signal generator and the adjustment units.

* * * * *